US006092914A

United States Patent [19]

Esakoff et al.

[11] Patent Number: 6,092,914

[45] Date of Patent: Jul. 25, 2000

[54] ZOOM LIGHTING FIXTURE HAVING MULTIFUNCTION ACTUATOR

[75] Inventors: Gregory F. Esakoff, Huntington Beach, Calif.; Fred R. Foster, Verona, Wis.

[73] Assignee: Electronics Theatre Controls, Middleton, Wis.

[21] Appl. No.: 09/102,717

[22] Filed: Jun. 22, 1998

[51] Int. Cl.[7] ..... F21V 29/00

[52] U.S. Cl. ..... 362/268; 362/319; 362/277; 362/280; 362/281; 362/331; 362/311

[58] Field of Search ..... 362/319, 277, 362/280, 281, 331, 268, 311

[56] References Cited

U.S. PATENT DOCUMENTS

| | | | |
|---|---|---|---|
| 1,742,600 | 1/1930 | Kliegl et al. | 362/281 |
| 1,767,756 | 6/1930 | Hall | 362/283 |
| 1,975,017 | 9/1934 | Orde | 353/56 |
| 2,425,863 | 8/1947 | Carlson | 355/67 |
| 2,650,292 | 8/1953 | Strong | 362/268 |
| 3,088,370 | 5/1963 | Erbe et al. | 359/823 |
| 3,116,022 | 12/1963 | Davis | 362/294 |
| 3,495,913 | 2/1970 | Hoagland | 356/124 |
| 4,101,957 | 7/1978 | Chang | 362/268 |
| 4,338,654 | 7/1982 | Logothetis | 362/268 |
| 4,462,067 | 7/1984 | Altman | 362/268 |
| 4,488,209 | 12/1984 | Gosswiller | 362/486 |
| 5,068,768 | 11/1991 | Kobayashi | 362/319 |
| 5,544,029 | 8/1996 | Cunningham | 362/293 |

*Primary Examiner*—Sandra O'Shea
*Assistant Examiner*—Ronald E. DelGizzi
*Attorney, Agent, or Firm*—Sheppard, Mullin, Richter & Hampton LLP

[57] ABSTRACT

A lighting fixture configured to image a high-intensity beam of light at a distant location with a variable beam spread and a variable image distance. The lighting fixture includes an illuminator mounted on a front projection system. The illuminator includes an elliptical reflector defining two focal points. A lamp is at one of the reflector's focal points, while an aperture of the front projection system is at the reflector's other focal point. The front projection system includes a tubular housing having shutter blades moveably positionable in the aperture to obstruct light passing through the second focal point. A rear lens receives and transmits light emitted by the illuminator, while a front lens is configured to receive light transmitted by the first lens and project it at the distant location. The lenses are contained within the housing. A positioning mechanism is mounted on the housing, and includes a rack and pinion gear device that adjusts the distance between the front and rear lenses in response to the rotation of an actuator. The actuator is configured to slide along a slot in the housing, controlling the translation of the first and second lenses with respect to the illuminator. The actuator is configured with a shielding baffle that covers the slot, and with field angle indicia labeling the actuator with beam spread settings. The actuator is further configured with a locking cam lever that constrains the actuator from being moved with respect to the housing when the locking cam lever is in a locked position.

29 Claims, 6 Drawing Sheets

ZOOM LIGHTING FIXTURE HAVING MULTIFUNCTION ACTUATOR

BACKGROUND OF THE INVENTION

This invention relates generally to lighting fixtures and more particularly, to lighting fixtures configured to image a high-intensity beam of light at a distant location with a variable beam spread and a variable image distance.

Lighting fixtures provide for controlled lighting of a subject in a wide variety of situations. Such fixtures are useful in theater, television, and architectural applications, as well as numerous other public visual displays. Commonly, a lighting technician positions lighting fixtures in a variety of positions around object(s) to be illuminated, and adjusts the fixtures to provide various beams of light. These beams each feature a desired aim, shape, beam spread, intensity, color, focus and image distance.

Typically, both the beam spread and the image distance of a lighting fixture's beam are adjusted by altering the position of one or more lenses in the fixture. Adjusting one of these two features (beam spread or image distance) typically alters the adjustment of the other feature, and thus, the beam spread and image distance must be adjusted concurrently, or iteratively, until both features are properly set. Commonly, it is unwieldy to make concurrent adjustments. This is particularly true when the lighting fixture's location is precarious, requiring the lighting technician to use one hand for other purposes, such as support. Thus, a technician commonly must iteratively adjust the beam spread and image distance until both are at their desired settings.

Lighting fixtures of this type typically include an illuminator having a lamp and an ellipsoidal or near-ellipsoidal reflector. The reflector defines two focal points. The lamp is positioned generally with its filaments located at or near a first of two focal points, such that light emitted from the lamp's filaments is reflected by the reflector generally toward the second focal point. A gate is located at that second focal point, such that shutters, patterns and other baffles can be used at the gate for shaping the projected beam of light.

A pair of lenses are used to project the beam of light at various beam spreads and image distances. Conventionally, the distance between each lens and the gate may be varied. In one known configuration, each lens has a control arm that may be moved to translate the lens closer to or farther from the gate. In another known configuration, one control arm translates the one lens with respect to the other, while another control arm translates the lens with respect to the two lenses. It is also known to use a rack and pinion arrangement to move lenses within a lighting fixture. In each of these arrangements, manipulation of a control to adjust a feature of the beam inherently changes another feature of the beam, and thus multiple controls must be operated, either concurrently or successively, to achieve a desired beam spread and image distance.

Accordingly, there has existed a definite need for a conveniently adjusted lighting fixture configured to image a high-intensity beam of light at a distant location with a variable beam spread and a variable image distance. The present invention satisfies these and other needs, and provides further related advantages.

SUMMARY OF THE INVENTION

The present invention provides a conveniently adjusted lighting fixture configured to project and image a high-intensity beam at a distant location with a variable beam spread and a variable image distance. The invention demonstrates both simple manufacture and use, along with attendant advantages related to simplicity.

The lighting fixture of the invention includes an illuminator mounted on a housing. A first optical component is configured to receive light emitted by the illuminator, and in turn, to transmit that light to a second optical component. The second optical component is configured to receive the light transmitted by the first optical component and project it at a distant location, imaging the light. Preferably, the optical components are both lenses. However, other optical components such as reflectors are within the scope of the invention.

One feature of the invention is that a positioning mechanism, mounted on the housing, is configured to control the position of the first and second optical components with respect to the illuminator. The positioning mechanism includes an actuator configured to be moved relative to the housing in a first degree of freedom to cause the positioning mechanism to adjust the distance between the first and second optical components. This adjusted distance controllably adjusts the beam spread of the imaged light.

The actuator is further configured to be moved in a second degree of freedom relative to the housing, causing the positioning mechanism to adjust the relative distance between the illuminator and the optical components. This adjustment controllably adjusts the distance at which the light is imaged.

This feature advantageously allows one-handed, simultaneous adjustment of both beam spread and imaging distance. A technician thus may conveniently adjust both the beam spread and the imaging distance of lighting fixtures situated in locations that are hard to reach and work with.

The lighting fixture of the invention also features a rack and pinion gear device as part of the positioning mechanism. The rack and pinion gear device provides for the actuator to rotationally control the distance between the optical components. The actuator is configured to be translated along an open slot in the housing, and thus allow for translational control of the optical components to adjust the distance at which the light is imaged. These features further provide for a mechanically simple device that is both inexpensive and reliable.

The actuator may further include a sliding baffle configured to cover portions of the slot. This baffle prevents light from entering the housing to become extraneous projected light.

Other features and advantages of the invention will become apparent from the following detailed description, taken in conjunction with the accompanying drawings, which illustrate, by way of example, the principles of the invention.

DETAILED DESCRIPTION OF THE PREFERRED EMBODIMENT

Figure 1:
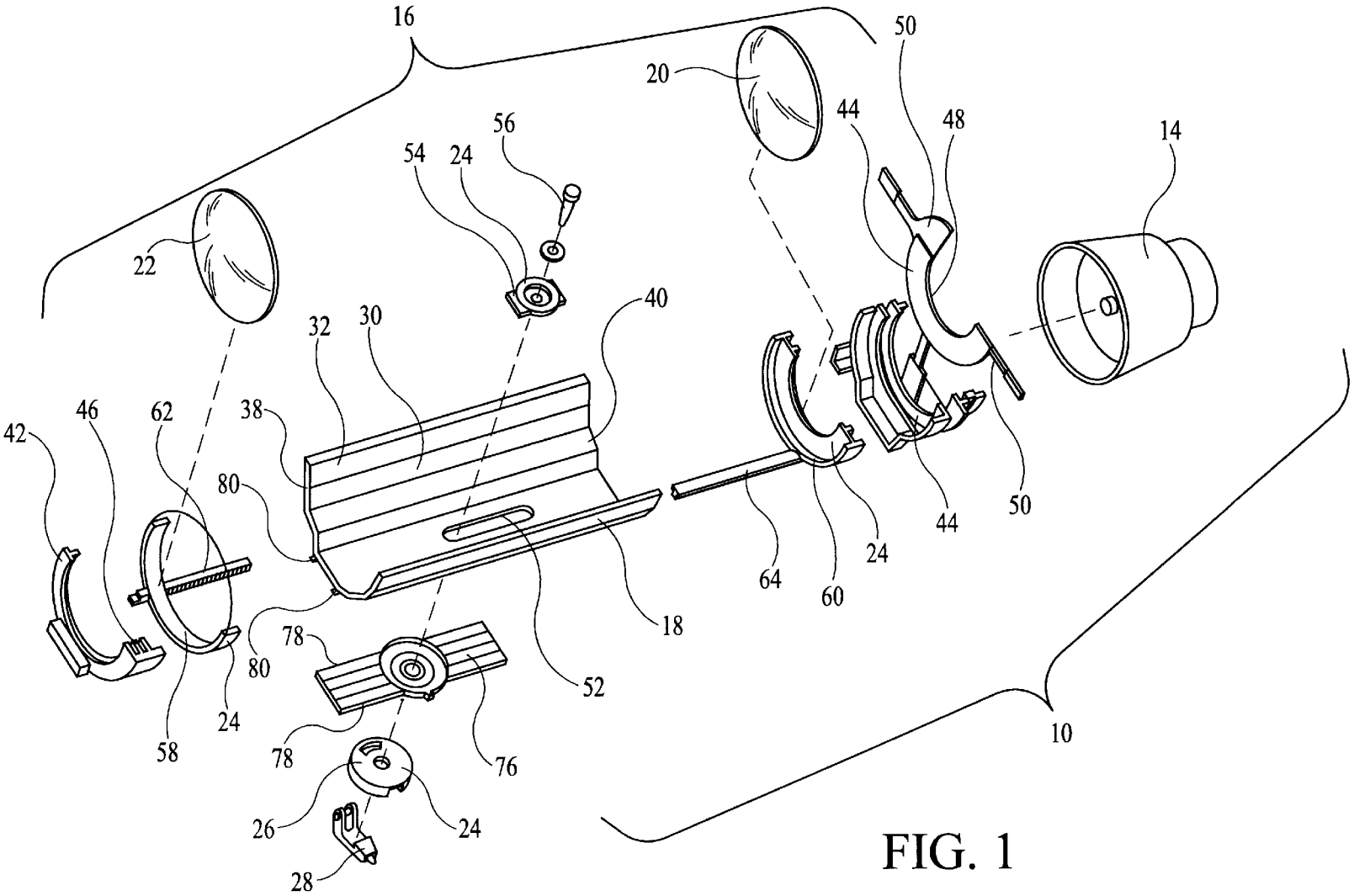
FIG. 1 is an exploded perspective view of a lighting fixture embodying features of the present invention.
Figure 2:
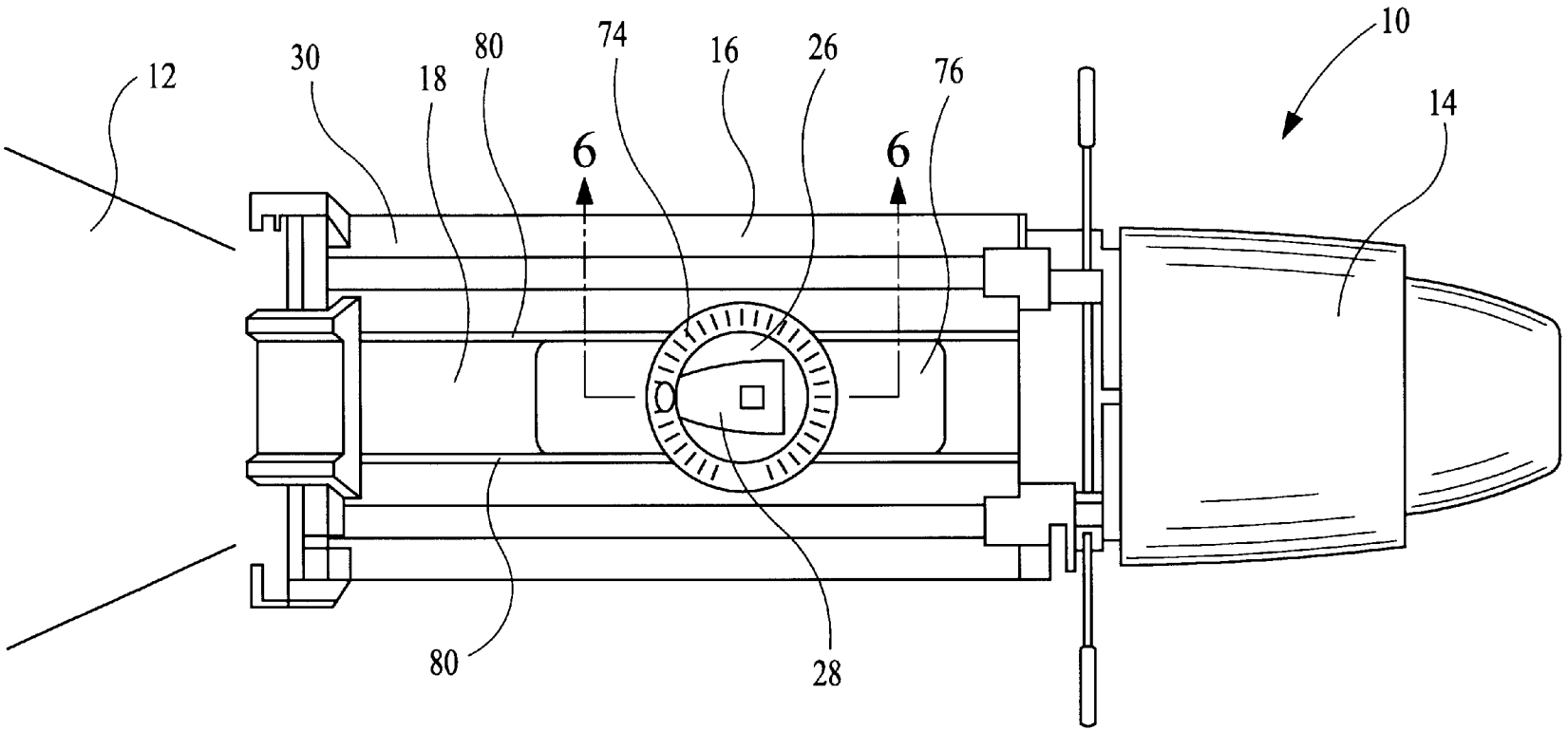
FIG. 2 is an elevational view of the lighting fixture depicted in FIG. 1.

A conveniently adjusted lighting fixture 10 configured to image a high-intensity beam 12 of light at a distant location with a variable beam spread and a variable image distance, according to the present invention, is shown in FIGS. 1 and 2. The system includes an illuminator 14 and a front projection system 16 that includes a housing 18 and two optical components. The first optical component is a rear lens 20, and the second optical component is a front lens 22. A positioning mechanism 24 is mounted on the housing, for controlling the position of the rear and front lenses with respect to the illuminator. The positioning mechanism forms a frame that includes an actuator 26 having a locking cam lever 28.

As shown in FIG. 1, the housing 18 includes a lens tube 30 having a generally cylindrical wall 32, with openings at a longitudinal front end 38 and a longitudinal rear end 40. A gel endcap 42 is located over the front end, and a gate endcap 44 is located over the rear end. The gel endcap is open, and includes flanges 46 configured to hold lighting gels (not shown), as is typically known. The gate endcap forms an aperture 48, and includes shutter blades 50 moveably positionable to partially or entirely obstruct light from passing through the aperture. The shutter blades form a beam shaping device near the plane of the gate, and provide image edges on the imaged light that may alter both the size and shape of the imaged light. Other beam shaping devices, such as templates, may also be used.

The gate endcap 44 is configured to receive light from the illuminator 14 through the aperture 48 and into the lens tube 30. The gate endcap may be alternatively configured with other devices that alter the size and/or shape of the aperture. For example, the gate endcap may include an iris (not shown) that shrinks or expands the size of the aperture without substantially changing the aperture's shape. Likewise, the gate endcap may include a slot (not shown) for the insertion of separate baffles (not shown) forming an aperture having a shape or size other than the gate endcap's aperture.

Figure 6:
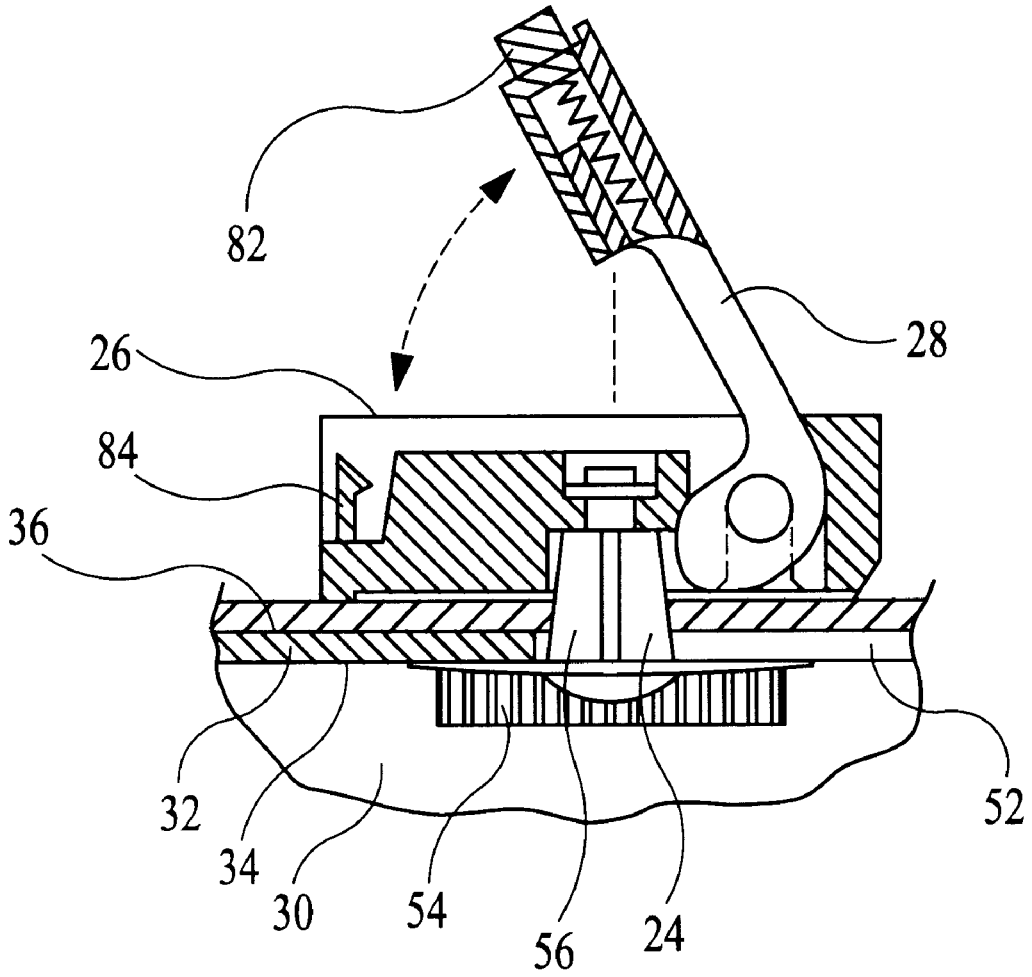
FIG. 6 is a cross-sectional elevation view of a locking cam lever, as found in the lighting fixture depicted in FIG. 1.

As shown in FIGS. 1 and 6, the lens tube 30 includes a longitudinally extending slot 52 to carry the positioning mechanism 24. The positioning mechanism includes a spur gear 54 located adjacent to the slot along the interior face of the lens tube wall 32. The actuator 26 is a knob located adjacent to the slot along the exterior face of the lens tube wall. The spur gear includes an integral shaft 56 extending through the slot in a direction normal to the lens tube wall at the slot. The integral shaft connects to, and interlocks with, the actuator, to receive loads from the actuator, causing the actuator and spur gear to be jointly rotated around the axis of the shaft in a rotational degree of freedom normal to the longitudinal direction of the lens tube, and jointly translated along the length of the slot in a degree of freedom parallel to the longitudinal direction of the lens tube.

The positioning mechanism 24 further includes a front lens holder 58 that holds the front lens 22, and a rear lens holder 60 that holds the rear lens 20. The front lens and rear lens are spaced longitudinally along the lens tube 30. A front rack 62 and a rear rack 64 are attached to the front and rear lens holders, respectively. The front and rear lens holders, with their attached racks, conform to the interior of the lens tube, and thus maintain their orientation within the lens tube while being longitudinally slidable within the lens tube.

The front and rear racks 62, 64 are configured within the lens tube 30 to form a rack and pinion gear system with the spur gear 54. Rotating the actuator 26 and spur gear around the axis of the shaft 56 in a first direction causes the rack and pinion system to pull the lenses 20, 22 toward each other, as depicted in the change from FIG. 3 to FIG. 4. Likewise, rotating the actuator and spur gear around the shaft in a second direction causes the rack and pinion system to push the lenses apart. Thus, when the actuator is moved relative to the housing in a rotational degree of freedom around the axis of the shaft, the actuator causes the adjustment of the distance between the front lens and the rear lens.

Figure 4:
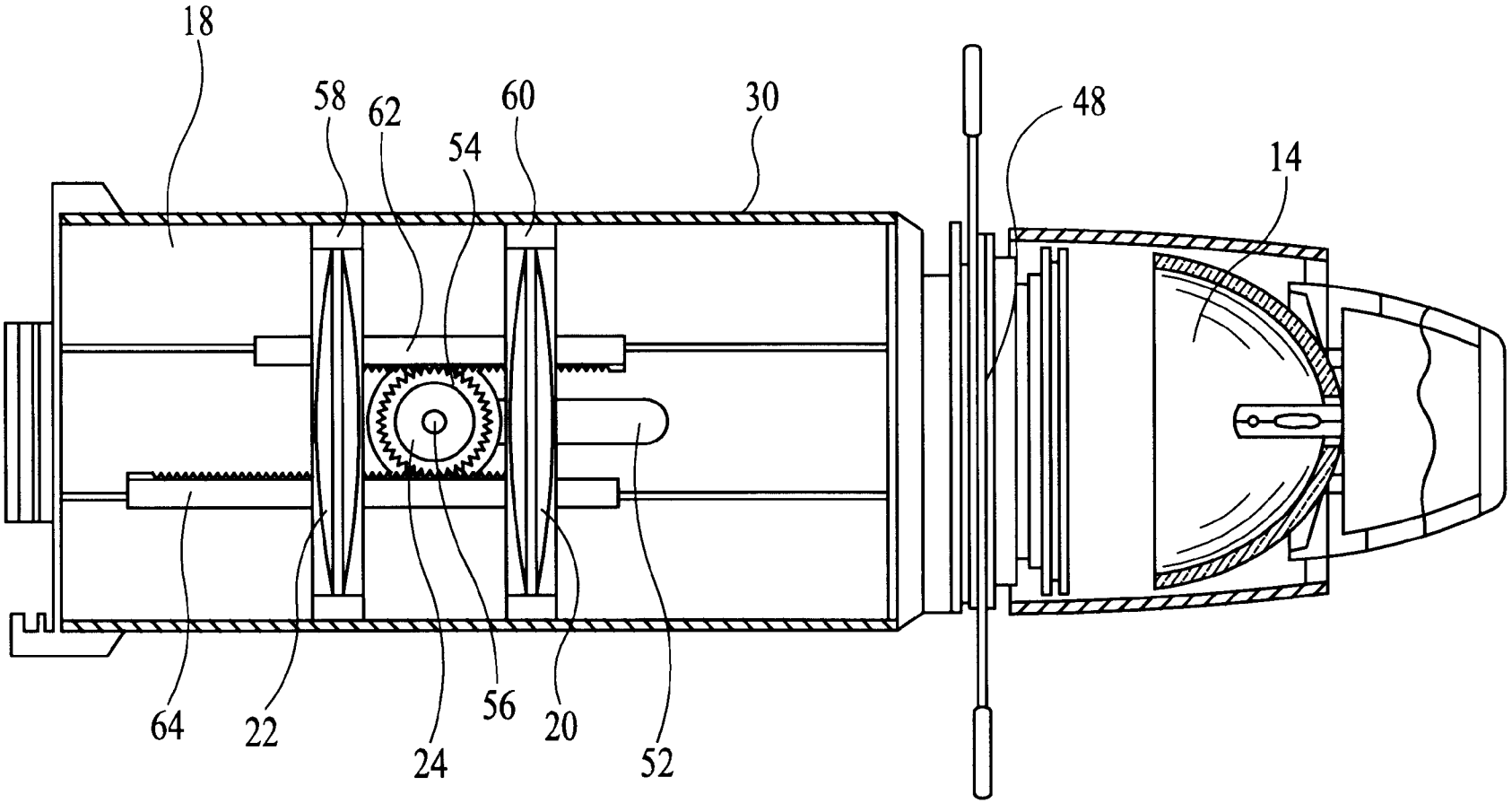
FIG. 4 is a cross-sectional elevation view of the lighting fixture depicted in FIG. 1, with lenses positioned in a forward, non-spread-apart position.
Figure 5:
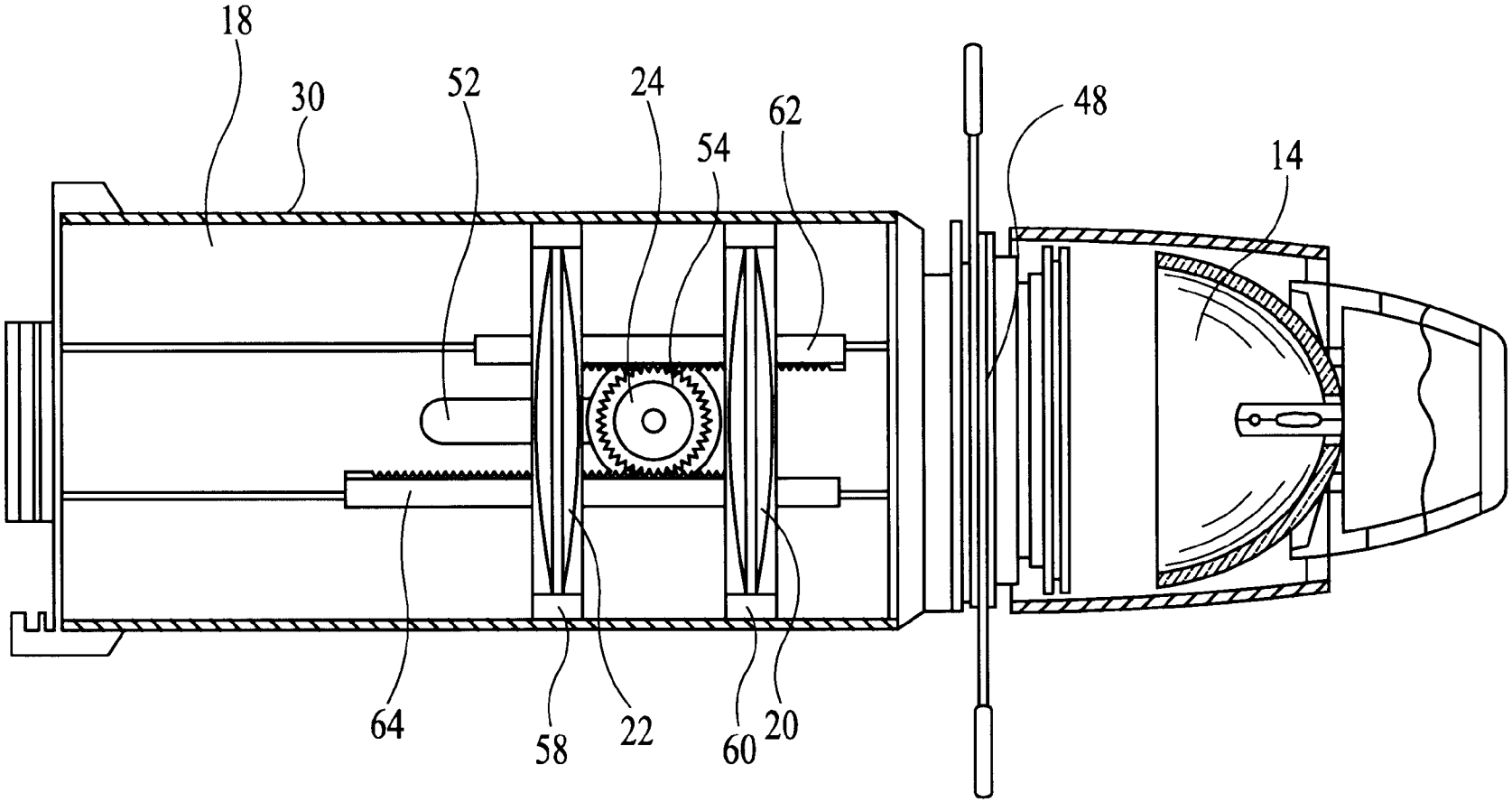
FIG. 5 is a cross-sectional elevation view of the lighting fixture depicted in FIG. 1, with lenses positioned in a rearward, non-spread-apart position.

Translating the actuator 26 and spur gear 54 longitudinally along the lens tube slot 52 causes the spur gear to pull and/or push on the racks 62, 64 to slide both lens holders 58, 60 longitudinally along the lens tube 30, as depicted in the change from FIG. 4 to FIG. 5. Thus, when the actuator is moved relative to the housing 18 in a translational degree of freedom along the slot, the actuator causes the adjustment of the relative position of each of the lenses 20, 22 within the housing, and therefore causes adjustment of the distance between the aperture 48 and the lenses, as well as between the illuminator 14 and the lenses. The positioning mechanism 24 therefore serves as a means for controlling the position of the lenses, with respect to the illuminator.

Figure 3:
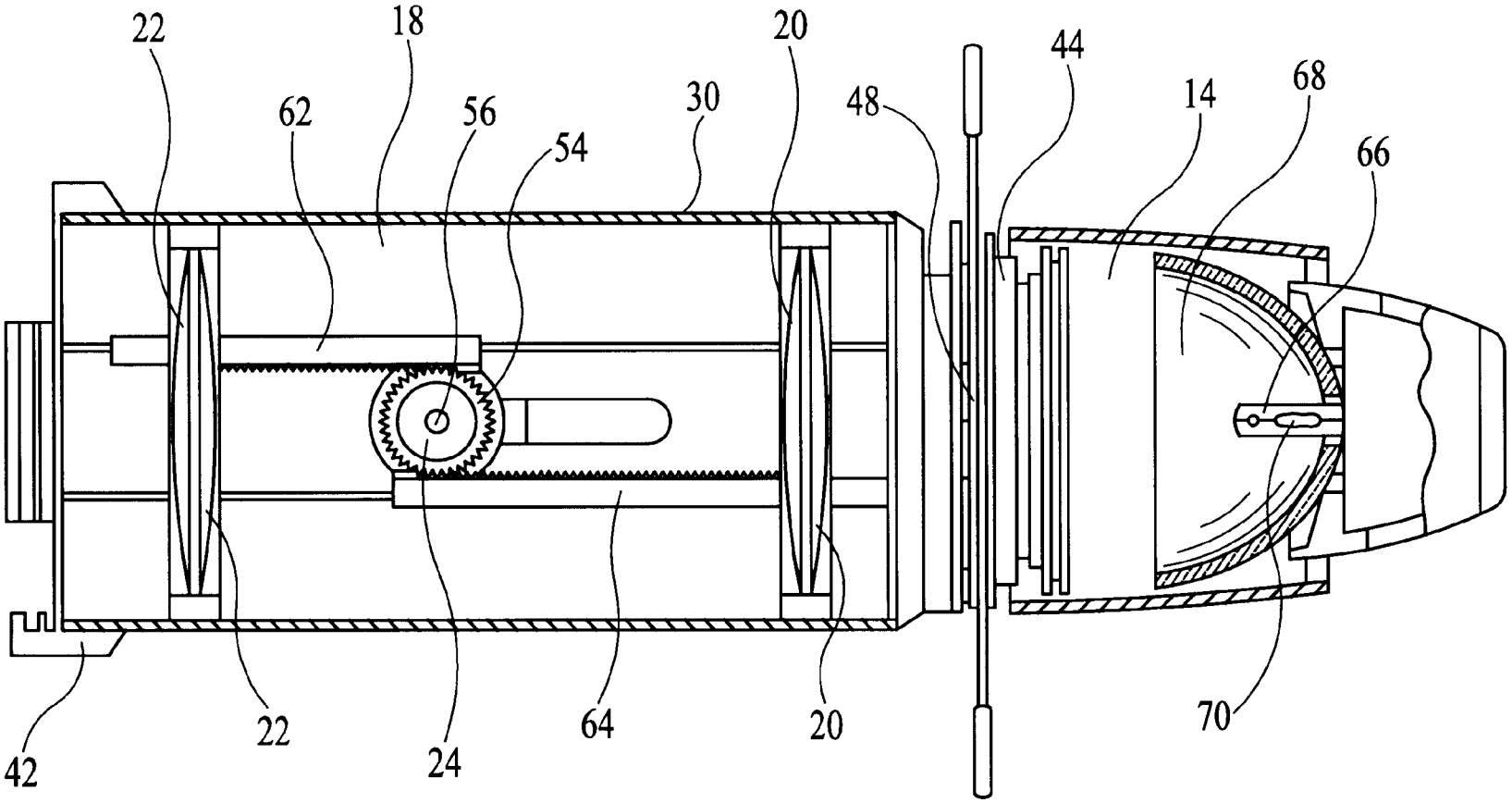
FIG. 3 is a cross-sectional elevation view of the lighting fixture depicted in FIG. 1, with lenses positioned in a forward and spread-apart position.

As shown in FIGS. 2 and 3, the illuminator 14 may be any typical light source or means for illuminating a housing. Preferably, the illuminator is a high intensity light engine including a lamp 66 and an approximately elliptical reflector 68. The reflector defines a first focal point and a second focal point, such that light originating at one focal point and reflecting off of the reflector will pass through the other focal point. The lamp contains filaments 70 located in the region of the first focal point.

The illuminator 14 detachably attaches to the gate endcap 44 such that the reflector's second focal point is located near the gate endcap's aperture 48 and any associated beam shaping device. The aperture allows a beam of the light from the illuminator to project into the housing 18.

The rear lens 20 and the front lens 22 are positioned, with respect to the illuminator 14, by the positioning mechanism 24. In combination, the rear and front lenses form an optical system to project the beam 12 of light out through the gel endcap 42, imaging the light. The optical system defines a focal point. The focal point has a characteristic focal length.

Decreasing the distance between the front lens 22 and the rear lens 20 causes the optical system's focal length to shorten, controllably increasing the beam spread of the projected light. Conversely, increasing the distance between the front lens and the rear lens causes the optical system's focal length to lengthen, controllably decreasing the beam spread of the projected light. The actuator includes field angle indicia 74 at intermittent rotational positions to indicate the beam spread produced by positioning the positioning mechanism at those positions.

Sliding the two lenses 20, 22 of the optical system along the lens tube 30 causes the optical system's focal point to move longitudinally with respect to the illuminator 14, and thus to move longitudinally with respect to the illuminator reflector's second focal point. The focal length of the optical system does not vary so long as the lenses are not moved relative to each other. Varying the position of the optical system's focal point with respect to the illuminator's second focal point adjusts the distance at which the light is imaged. If the beam illuminates an object located where the light is imaged, the imaged beam accurately projects light in the shape of the aperture 48. If, however, the beam illuminates an object located at a distance other than where the light is imaged, the beam projects a blurry image in the shape of the aperture.

As shown in FIGS. 1 and 2, the positioning mechanism 24 further includes a sliding baffle 76 configured to cover portions of the lens tube slot 52 that are not covered by the actuator 26. This sliding baffle is configured to cover the slot regardless of the actuator's position. Opposing edges 78 of the sliding baffle are received in guide rails 80 formed in the housing 18. The guide rails retain the baffle in the correct rotational position to cover the slot, while allowing the baffle to slide with the actuator. The guide rails also serve to further block light from escaping from the housing.

While the preferred embodiment includes a slot covered by a baffle, other embodiments are well within the scope of the invention. For example, an embodiment could have a positioning mechanism that extends through a hole in the housing, where the housing itself includes two seperate portions that move with respect to each other. Such a device might not require a baffle as described above.

The actuator 26 further includes a locking cam lever 28 that constrains the actuator from being moved with respect to the lens tube 30 when the locking cam lever is in a locked position, as seen in FIG. 2. The locking cam lever may be held in the locked position by a spring loaded button 82 that causes a latch mechanism 84 to unlatch when the button is depressed. The locking cam lever must be released by depressing the release button and then raised to an unlocked position (as seen in FIG. 6) for the actuator to be moved in the locked degrees of freedom. Such locking mechanisms can be configured to constrain the actuator in one or more degrees of freedom.

A second embodiment of the invention includes all of the above-described structure, and further includes one or more light-affecting components, such as lenses, reflectors, templates, diffusors or filters (absorptive or reflective, color, infrared or ultraviolet, etc.). Each of these additional light-affecting components are constrained to move in conjunction with one or both of the racks 62, 64. Preferably, the positioning mechanism is configured to carry light-affecting components such as lenses or reflectors along with one of the racks, so that the component moves precisely in tandem with the optical component 20 or 22 carried by that rack. Preferably, the positioning mechanism is configured to carry light-affecting components such as templates, diffusors or filters in tandem with the translating movement of the actuator 26. Other variations of this embodiment may include light-affecting components that move proportionate to one rack with respect to the housing 18, or move proportionate to one rack with respect to the other.

From the foregoing description, it will be appreciated that the present invention provides a conveniently adjusted lighting fixture configured to image a high-intensity beam of light at a distant location with a variable beam spread and a variable image distance. While a particular form of the invention has been illustrated and described, it will be apparent that various modifications can be made without departing from the spirit and scope of the invention.

For example, the use of other optical components, such as reflectors, is within the scope of the invention. Likewise, the use of a non-elliptical illuminator, which might not have a second focal point, is also well within the scope of the invention.

Thus, although the invention has been described in detail with reference only to the preferred embodiment, those having ordinary skill in the art will appreciate that various modifications can be made without departing from the invention. Accordingly, the invention is not intended to be limited, and is defined with reference to the following claims.

We claim:

1. A lighting fixture for imaging light at a distant location, comprising:

a housing;

an illuminator;

a first optical component configured to receive and transmit light emitted by the illuminator;

a second optical component configured to receive light transmitted by the first optical component and project it at the distant location to image the light; and a positioning mechanism mounted on the housing and configured to control the position of the first and second optical components with respect to the illuminator, the positioning mechanism having an actuator;

wherein the actuator is configured to be moved relative to the housing in a first independent degree of freedom, to adjust the distance between the first optical component and the second optical component, and thereby controllably adjust a beam spread of the imaged light; and wherein the actuator is configured to be moved relative to the housing in a second independent degree of freedom, to adjust the relative distance between the illuminator and the first and second optical components, and thereby controllably adjust the distance at which the light is imaged.

2. The lighting fixture of claim 1, wherein the first independent degree of freedom of the actuator is rotational, and the second independent degree of freedom of the actuator is translational.

3. The lighting fixture of claim 2, wherein:

the first independent degree of freedom of the actuator is a rotation about an axis normal to a longitudinal direction between the first and second optical components; and the second independent degree of freedom of the actuator is a translation in the longitudinal direction between the components.

4. The lighting fixture of claim 3, wherein the actuator is configured to be slidably moved along an open slot in the housing, and the positioning mechanism further includes a sliding baffle configured to cover portions of the open slot.

5. The lighting fixture of claim 4, wherein opposing edges of the baffle are received in guide rails on the housing.

6. The lighting fixture of claim 2, wherein the actuator is further configured with field angle indicia.

7. The lighting fixture of claim 1, wherein the positioning mechanism is configured with a rack and pinion device to adjust the distance between the first and second optical components in response to rotating the actuator in its first independent degree of freedom.

8. The lighting fixture of claim 7, wherein the first independent degree of freedom of the actuator is a rotation about an axis normal to a longitudinal direction between the first and second optical components.

9. The lighting fixture of claim 1, wherein the housing includes a lens tube, the first optical component is a lens within the lens tube, and the second optical component is a lens within the lens tube.

10. The lighting fixture of claim 1, wherein the illuminator includes an elliptical reflector defining a first focal point, and a lamp containing filaments located in the region of the first focal point.

11. The lighting fixture of claim 10, wherein the elliptical reflector defines a second focal point, and the housing includes a beam shaping device near the second focal point that delimits a boundary of the imaged light.

12. The lighting fixture of claim 1, wherein the actuator further includes a locking cam lever that constrains the actuator from being moved with respect to the housing when the locking cam lever is in a locked position.

13. A lighting fixture for imaging light at a distant location, comprising:

a housing;

an illuminator;

one or more optical components; and a positioning mechanism mounted on the housing and configured to control the position of the one or more optical components with respect to the illuminator, the positioning mechanism having an actuator;

wherein the one or more optical components are positioned by the positioning mechanism to form an optical system, the optical system being characterized by a focal point positioned at a focal length that can be varied;

wherein the actuator is configured to be moved relative to the housing in a first independent degree of freedom to vary the optical system's focal length; and wherein the actuator is configured to be moved relative to the housing in a second independent degree of freedom to vary the relative positions of the illuminator and the optical system's focal point without significantly varying the optical system's focal length.

14. The lighting fixture of claim 13, wherein the first independent degree of freedom of the actuator is rotational, and the second independent degree of freedom of the actuator is translational.

15. The lighting fixture of claim 14, wherein the actuator is configured to be translated along an open slot in the housing, and the positioning mechanism further includes a sliding baffle configured to cover portions of the slot.

16. The lighting fixture of claim 15, wherein opposing edges of the baffle are received in guide rails on the housing.

17. A front projection system for imaging light at a distant location, comprising:

a housing defining an aperture for receiving light;

a first optical component configured to receive and transmit light received by the aperture;

a second optical component configured to receive light transmitted by the first optical component and project it at the distant location to image the light;

a positioning mechanism mounted on the housing and configured to control the position of the first and second optical components with respect to the aperture, the positioning mechanism having an actuator;

wherein the actuator is configured to be moved relative to the housing in a first independent degree of freedom to adjust the distance between the first optical component and the second optical component; and wherein the actuator is configured to be moved relative to the housing in a second independent degree of freedom to adjust the relative distance between the aperture and the first and second optical components.

18. The front projection system of claim 17, wherein the first independent degree of freedom of the actuator is rotational, and the second independent degree of freedom of the actuator is translational.

19. The front projection system of claim 18, wherein:

the first independent degree of freedom of the actuator is a rotation about an axis normal to a longitudinal direction defined by the housing; and the second independent degree of freedom of the actuator is a translation in the longitudinal direction.

20. The front projection system of claim 17, wherein the positioning mechanism is configured with a rack and pinion device to adjust the distance between the first and second optical components in response to rotating the actuator.

21. The front projection system of claim 17, wherein the actuator further includes a locking cam lever that constrains the actuator from being moved with respect to the housing when the locking cam lever is in a locked position.

22. A lens positioning mechanism for positioning a first optical component and a second optical component on a housing to image a beam of light at a distant location, comprising:

an adjustable frame configured to be mounted on the housing, the frame having an actuator;

wherein the frame is configured to positionably control the first optical component and the second optical component with respect to the housing;

wherein the actuator is configured to be moved relative to the housing in a first independent degree of freedom to adjust the distance between the first optical component and the second optical component; and wherein the actuator is configured to be moved relative to the housing in a second independent degree of freedom to displace each optical component relative to the housing, while maintaining each optical components position relative to the other optical component.

23. The lens positioning mechanism of claim 22, wherein the first independent degree of freedom of the actuator is rotational, and the second independent degree of freedom of the actuator is translational.

24. The lens positioning mechanism of claim 22, wherein the frame includes a rack and pinion device.

25. The lens positioning mechanism of claim 22, wherein the actuator further includes a locking cam lever that constrains the actuator from being moved with respect to the housing when the locking cam lever is in a locked position.

26. A method of imaging light from an illuminator, at a distant location, comprising:

providing a housing, a first optical component, and a second optical component, wherein the first and second optical components are configured to project the light at the distant location to image the light, wherein the housing includes an actuator configured to adjust the distance between a first optical component and a second optical component in response to being moved in a first independent degree of freedom, and wherein the actuator is configured to displace each optical component relative to the housing, while maintaining each optical component's position relative to the other optical component, in response to being moved in a second independent degree of freedom;

moving the actuator in its first independent degree of freedom relative to the housing to controllably adjust the beam spread; and moving the actuator in its second independent degree of freedom relative to the housing to controllably adjust the distance at which the light is imaged.

27. The method of claim 26, wherein the first independent degree of freedom of the actuator is rotational, and the second independent degree of freedom of the actuator is translational.

28. The method of claim 27, wherein the step of moving an actuator in its first independent degree of freedom causes the rotation of a gear in a rack and pinion device to adjust the distance between the first and second optical components.

29. A lighting fixture for imaging light at a distant location, comprising:

a housing;

a means for illuminating the housing;

one or more optical components; and a means for controlling the position of the one or more optical components with respect to the means for illuminating, the means for controlling being mounted on the housing and having an actuator;

wherein the one or more optical components are positioned by the means for controlling to form an optical system, the optical system being characterized by a focal point positioned at a focal length that can be varied;

wherein the actuator is configured to be moved relative to the housing in a first independent degree of freedom to vary the optical system's focal length; and wherein the actuator is configured to be moved relative to the housing in a second independent degree of freedom to vary the relative positions of the illuminator and the optical system's focal point without significantly varying the optical system's focal length.

* * * * *

UNITED STATES PATENT AND TRADEMARK OFFICE

CERTIFICATE OF CORRECTION

PATENT NO. : 6,092,914

DATED : July 25, 2000

INVENTOR(S) : Gregory E. Esakoff et al.

It is certified that error appears in the above-identified patent and that said Letters Patent are hereby corrected as shown below:

At column 8, line 31, change "components" to –component's–. (PTO error)

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*